US005572859A

United States Patent [19]

Derichs et al.

[11] Patent Number: 5,572,859

[45] Date of Patent: Nov. 12, 1996

[54] INDIVIDUAL-MOTOR DRIVE FOR SPINNING-MACHINE SPINDLE

[75] Inventors: Josef Derichs, Mönchengladbach; Friedrich Dinkelmann, Maitis; Günter Neuburger, Geislingen; Ernst Halder, Wäschenbeuren; Ewald Nägele, Göppingen, all of Germany

[73] Assignee: Zinser Textilmaschinen GmbH, Ebersbach/Fils, Germany

[21] Appl. No.: 500,190

[22] Filed: Jul. 10, 1995

[30] Foreign Application Priority Data

Jul. 11, 1994 [DE] Germany ..... 44 24 349.9

[51] Int. Cl.[6] ..... D01H 13/00; D01H 13/18

[52] U.S. Cl. ..... 57/100; 57/61; 57/78; 57/88; 310/68 A

[58] Field of Search ..... 310/68 A, 67 R, 310/71; 57/100, 61, 78, 88, 89, 81

[56] References Cited

U.S. PATENT DOCUMENTS

| | | | |
|---|---|---|---|
| 630,567 | 8/1899 | Sawyer et al. . | |
| 1,840,642 | 1/1932 | Stone | 57/81 |
| 2,138,658 | 11/1938 | Hongo | 57/100 |
| 3,879,926 | 4/1975 | Bartling et al. | 57/81 |
| 4,128,988 | 12/1978 | Ragan | 57/100 |
| 4,817,371 | 4/1989 | Wolf | 57/100 |
| 5,099,640 | 3/1992 | Kobayashi et al. | 57/100 |
| 5,224,331 | 7/1993 | Stahlecker et al. | 57/100 |
| 5,231,819 | 8/1993 | Stahlecker et al. | 57/100 |

FOREIGN PATENT DOCUMENTS

| | | | |
|---|---|---|---|
| 548109 | 4/1932 | Germany . | |
| 819660 | 11/1951 | Germany . | |
| 3727939 | 3/1989 | Germany . | |
| 3838418 | 3/1990 | Germany | 57/100 |
| 3912370 | 10/1990 | Germany . | |
| 4106953 | 9/1992 | Germany . | |
| 358378 | 4/1938 | Italy . | |

*Primary Examiner*—William Stryjewski
*Attorney, Agent, or Firm*—Herbert Dubno; Andrew Wilford

[57] ABSTRACT

A spinning- or twisting-machine has an elongated spindle bank, a row of rotatable spindles supported on the bank, respective individual drive motors on the bank for each spindle, respective electrical control circuits connected to the respective motors and electrically energizable to power the respective motor, and a plurality of electricity-supply conductors extending along the bank past the spindles. A respective housing support part for each spindle carries the respective electrical control circuit and is provided with electrical-input contacts. A mount engaged between the housing part and the spindle bank allows movement of the housing part on the bank between a closed position in which it surrounds and protects the respective circuit and in which the contacts conductively engage the supply conductors and an open position in which it exposes the respective circuit and disengages the contacts from the supply conductors.

14 Claims, 7 Drawing Sheets

INDIVIDUAL-MOTOR DRIVE FOR SPINNING-MACHINE SPINDLE

FIELD OF THE INVENTION

The present invention relates to a spindle of a spinning machine. More particularly this invention concerns an individual-motor drive for such a spindle.

BACKGROUND OF THE INVENTION

A standard spinning or twisting machine has a horizontally elongated spindle bank or beam on which is supported a row of equispaced and parallel spindles rotatable about respective upright axes defining a vertical plane. Each spindle can be powered as described in U.S. Pat. Nos. 630,567 of Sawyer and 4,817,371 of Wolf, in German patent documents 548,109, 819,660, 3,727,939, 3,912,370, and 4,106,953, and in Italian patent 3,358,378 by a respective electric motor. The advantage of this is that it is possible to provide some degree of individualized control for each spindle. To do this each motor must be provided with its own electrical control circuit.

Thus in the standard system a plurality of electrical-supply conductors extend the full length of the spindle beam and are connected at each spindle assembly to the respective control circuitry. In turn this circuitry is of course wired to the respective motor.

When trouble develops with one spindle it is frequently necessary to deenergize the entire spindle bank so as to be able to work on the nonfunctional spindle control circuit while same is not energized. This leads to substantial losses in production, but is necessary to be able to safely disconnect a control circuit or trouble-shoot it. Normally a substantial housing must be removed to reveal the control circuits of the spindle bank, then the individual module is worked on.

Even though above-cited Italian 358,378 and German 4,106,953 propose individual cutoff switches for the spindle motors and control circuits, it is still frequently necessary to shut down the entire bank to actually work on a single part of it, in particular when it must be disconnected and replaced which is normally all that the machine operators do.

OBJECTS OF THE INVENTION

It is therefore an object of the present invention to provide an improved spindle assembly for a spinning or twisting machine.

Another object is the provision of such an improved spindle assembly for a spinning or twisting machine which overcomes the above-given disadvantages, that is which allows individual spindle assemblies to be worked on without affecting adjacent spindle assemblies.

SUMMARY OF THE INVENTION

A spinning- or twisting-machine has an elongated spindle bank, a row of rotatable spindles supported on the bank, respective individual drive motors on the bank for each spindle, respective electrical control circuits connected to the respective motors and electrically energizable to power the respective motor, and a plurality of electricity-supply conductors extending along the bank past the spindles. According to the invention a respective housing support part for each spindle carries the respective electrical control circuit and is provided with electrical-input contacts. A mount engaged between the housing part and the spindle bank allows movement of the housing part on the bank between a closed position in which it surrounds and protects the respective circuit and in which the contacts conductively engage the supply conductors and an open position in which it exposes the respective circuit and disengages the contacts from the supply conductors.

Thus when the housing support part is moved into the open position it automatically disconnects the respective circuit and motor from the electrical supply and exposes it so it can be checked out and worked on. This makes it possible to work on the individual assembly and even replace its controller without affecting the adjacent spindle assemblies. The controller can even be provided with warning lights to indicate various malfunctions, for instance yarn breakage.

According to another feature of this invention a latch is provided for retaining the housing support part in the closed position. This latch can be a magnetic or snap catch, or a simple screw connection.

The system according to the invention can also have respective disengageable pairs of energy-output contacts between the circuits and the respective motors. The energy-output contacts are engaged together in the closed position and disengaged from each other in the open position. Thus when the housing is opened the entire control circuit is disconnected. It can then be easily replaced with an operational unit so the failed one can be sent to the shop for testing and repair, further reducing down time of the machine.

An outer housing shell part extending longitudinally over a plurality of housing support parts according to this invention and a separate mount are engaged between the housing shell part and the spindle bank for movement of the housing shell part on the bank between a closed position in which it surrounds and protects the respective circuit housing support parts and an open position in which it exposes the respective housing support parts. Thus this outer shell can be opened up, normally without shutting down the spindle bank, so the individual controls can be checked while still running. The outer shell serves to keep lint and the like out of the control circuits on the inside support parts.

The mount according to this invention can be a simple hinge. It can also include an upwardly open gudgeon operatively fixed on the spindle bank and a pivot pin fixed on the housing support part and pivotally engageable in the respective gudgeon. A slide connections is also usable. Normally the spindle bank includes a respective motor housing at each spindle. The mount is connected between each housing support part and the respective motor housing. In addition each of the contacts includes a slidable pin and a spring braced between the pin and the housing support part.

According to another feature of the invention the spindle is axially removably mounted on the spindle bank and a latch is provided on each of the housing support parts for, in a retaining position of the latch means, retaining the respective spindles against removal from the spindle bank in the closed position of the respective housing support part. The latch can be a cutout on each housing support part that snugly engages in the respective closed position around the spindle and forms the latch means. Alternately the latch includes a respective spring braced between the respective latch and the spindle bank and urging the latch means into the retaining position. In this arrangement the latch includes a slide formed with a cutout engaged around the spindle and displaceable between the retaining position with the cutout engaged snugly around at least part of the spindle and a freeing position permitting the spindle to pass axially through the cutout, and an actuator on the housing support part for pushing the respective slide into the retaining position on movement of the housing support part into the closed position.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
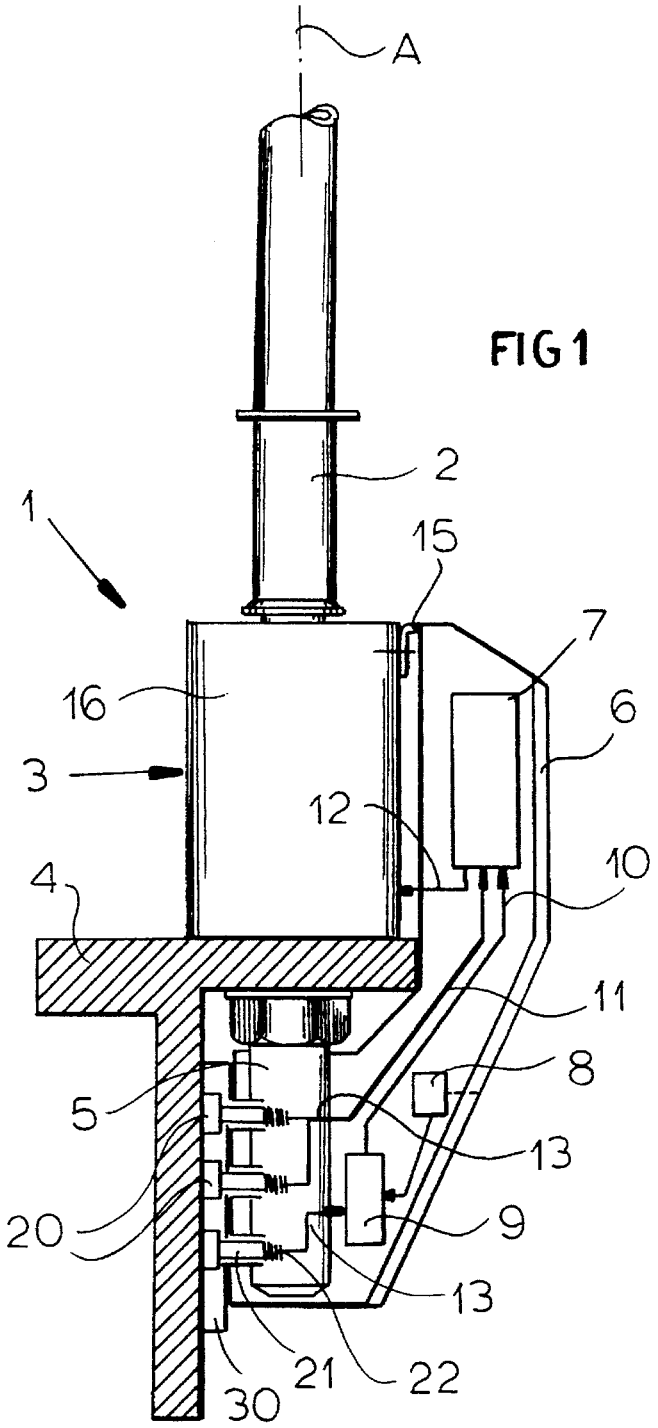
FIG. 1 is a vertical section through a spindle bank showing the drive according to the invention in side view.
Figure 2:
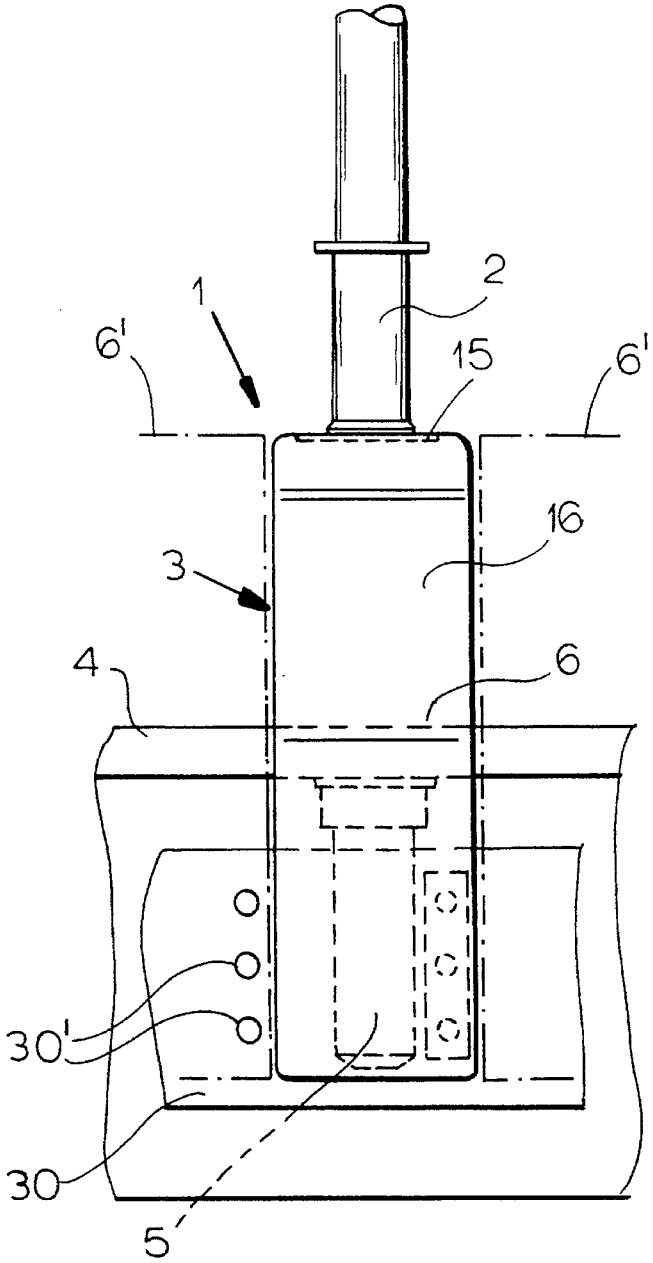
FIG. 2 is a front view of the drive of FIG. 1.

As seen in FIGS. 1 and 2 a spindle assembly 1 of a spinning or twisting machine sits with a row of other such assemblies on a horizontal bank or beam 4. The assembly 1 comprises a spindle 2 rotatable above the beam 4 about a vertical axis A and supported underneath the beam 4 in a bearing 5. A motor 3 sitting atop the beam 4 and surrounding the spindle 1 rotates it, and normally the spindle 2 can be lifted vertically up out of the motor 3. The beam 4 carries three parallel electrical conductors or contact bars 20 that are contained in a protective cover 30 formed at each assembly 1 with three holes 30' through which contact can be made with these bars 20.

Each spindle assembly 1 further has a casing or housing 6 in which are mounted a direction controller 7, shutoff switch 8, and controller 9 as well as conductors 10, 11, 12, and 13 interconnecting these parts. Furthermore the housing 6 carries three contact pins 21 urged outward by respective springs 22 and connected via the conductors 13 to the various electronic and electrical elements 7, 8, and 9 and positioned so that when the housing 6 is closed as shown in FIG. 1 the contact pins 21 engage through the respective holes 30' and press against the respective commutator bars 20.

Figure 3:
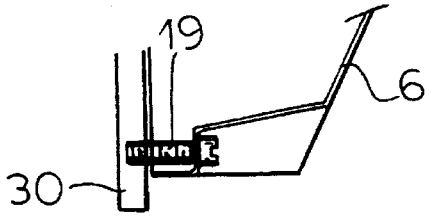
FIG. 3 is a detail view indicating a variant on the drive of FIGS. 1 and 2.

At its upper end the housing 6 is secured via a hinge 15 defining a horizontal axis parallel to the beam 4 with a housing 16 of the motor 3. When closed it is possible as shown in FIG. 3 for a screw 19 acting as latch means to engage through the housing 6 with the conductor cover 30 to hold the housing 6 shut. In this position the contact pins 21 are pressed against the bars 20, making good electrical contact therewith. FIG. 2 shows at 6' the outlines of adjacent housings 6 of adjacent assemblies 1, together forming a continuous front plane.

Figure 4:
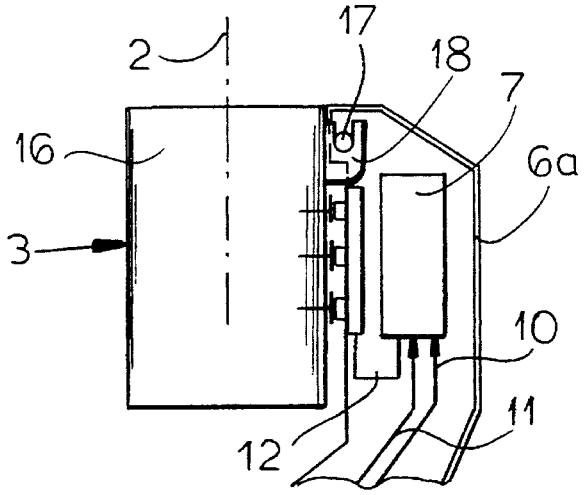
FIG. 4 is a detail view of another variant on the drive of FIGS. 1 and 2.

In FIG. 4 instead of a hinge 15 the housing *6a* is provided with a pin 17 that can sit in upwardly open pivots or gudgeons 18 mounted on the motor housing 16. In addition the conductors 12 from the direction-controller 7 to the motor 3 are connected thereto via spring-loaded contacts 25 similar to the contact pins 21. Thus the entire unit constituted by the housing *6a*, that is holding all the electrical and electronic control circuitry for the motor 3, can be lifted off and replaced with ease.

Figure 5:
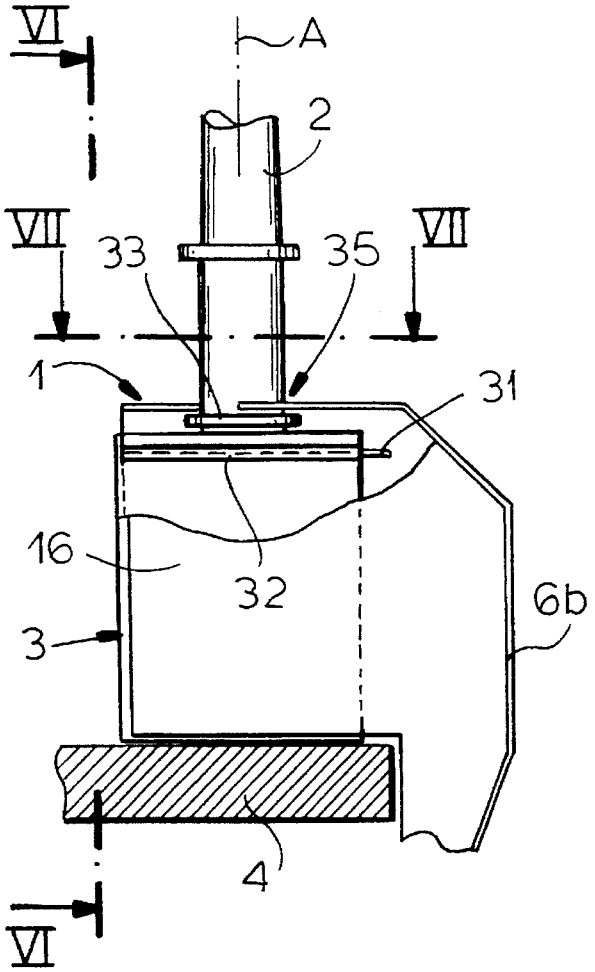
FIG. 5 is a view like FIG. 1 of a second embodiment of the invention.
Figure 6:
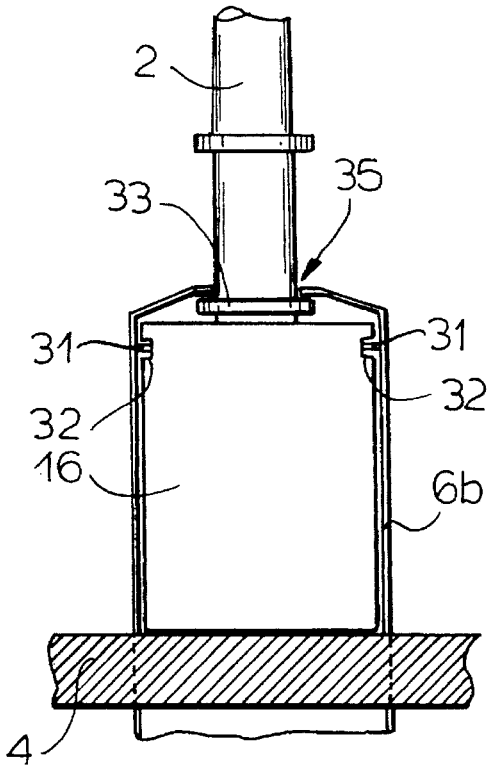
FIGS. 6 and 7 are sections taken along respective lines VI—VI and VII—VII of FIG. 5.
Figure 7:
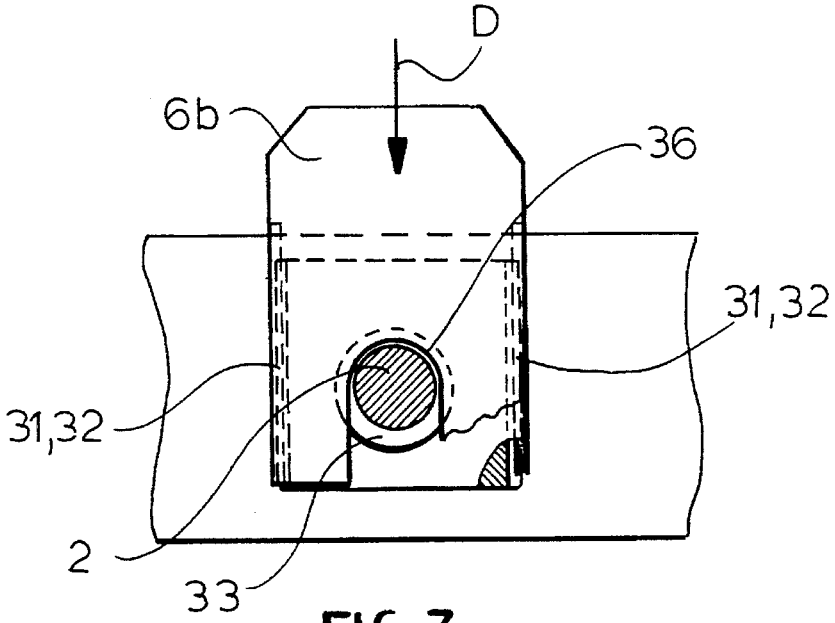

The arrangement of FIGS. 5 through 7 has a housing *6b* that also serves to retain the spindle 2 in place in the motor 3. To this end the spindle 2 is formed as is standard with a radially outwardly projecting ridge or collar 33 and the motor housing 16 with two horizontally extending, parallel, and oppositely outwardly open grooves 32. The housing *6b* itself is formed at 35 with a notch 36 that can snugly fit around the spindle 2 above the collar 33 and with ribs or ridges 31 that can fit into the grooves 32 as shown in FIG. 7. Thus as the housing *6b* is pushed in direction D into the closed position, it fits around the spindle 2 and into the motor housing 16 and prevents the spindle 2 from being lifted up out of the motor 3.

Figure 8:
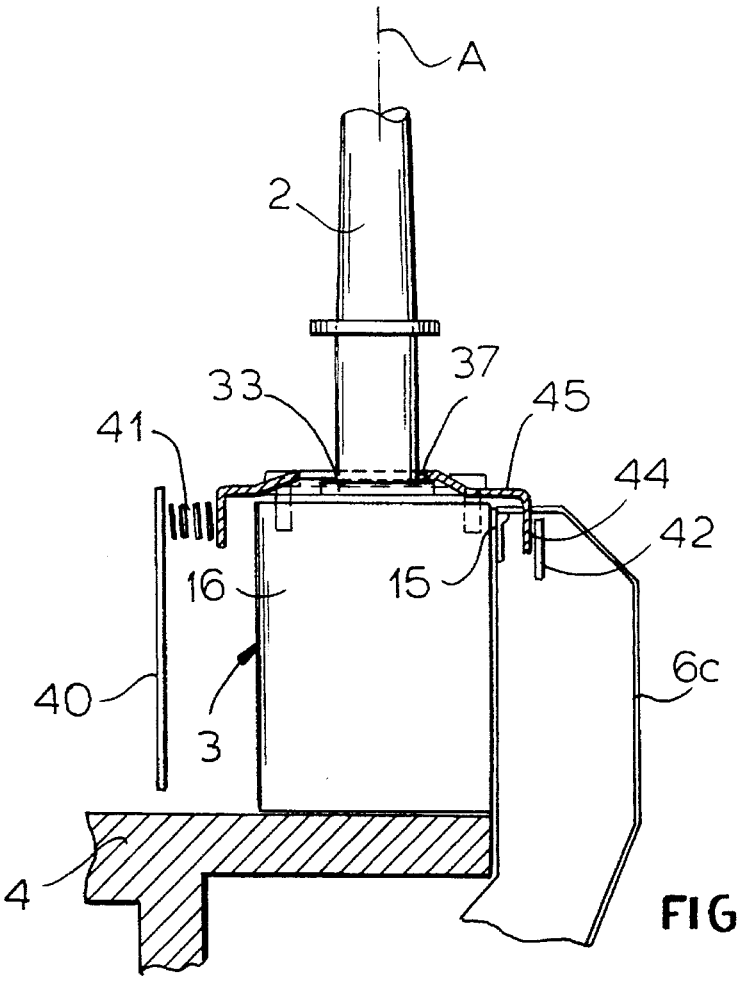
FIG. 8 is a view like FIG. 1 of a third embodiment of the invention in the closed position.
Figure 9:
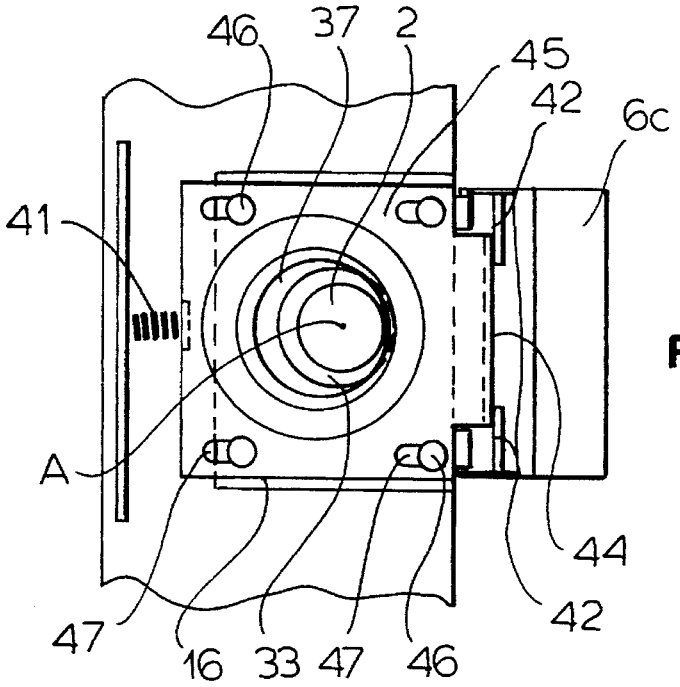
FIG. 9 is a top view of the structure of FIG. 8.
Figure 10:
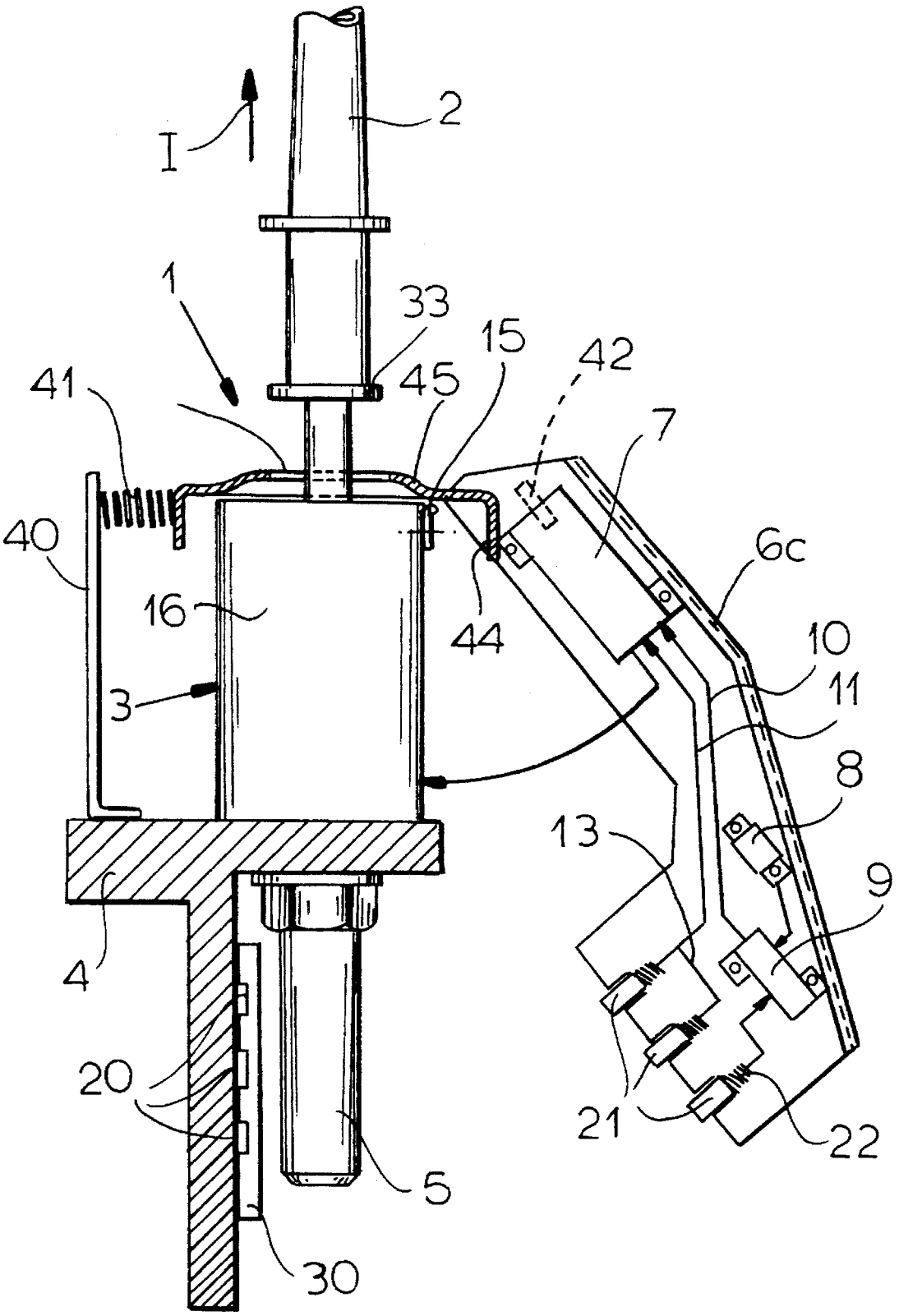
FIG. 10 is a view like FIG. 8 of the third embodiment but in the open position.

The system of FIGS. 8 through 10 has a housing *6c* that also serves indirectly for retaining the spindle 2 in place. To this end the motor housing 1 carries guide pins 46 that fit through elongated slots 47 in a retaining plate 45 that is formed with a circular hole 37 that, when concentric with the spindle axis A, can pass the collar 33 but when offset cannot. This plate 45 is slid horizontally into the aligned/freeing position shown in FIG. 10 by a spring 41 braced against an abutment 40 fixed on the beam 4 and has a pusher flange 44 that can engage pusher tabs 42 formed on the housing *6c*. Thus when the housing *6c* is set in the closed position as shown in FIGS. 8 and 9 the pusher tabs 42 push back the plate 45 to offset the hole 37 from the axis A and thereby lock the spindle 2 in place in the motor 3. When the housing is opened as shown in FIG. 10, however, the spring 41 pushes the retaining plate 45 outward so that the hole 37 can pass the collar 33 and the spindle 2 can be lifted out in axial direction I.

Figure 11:
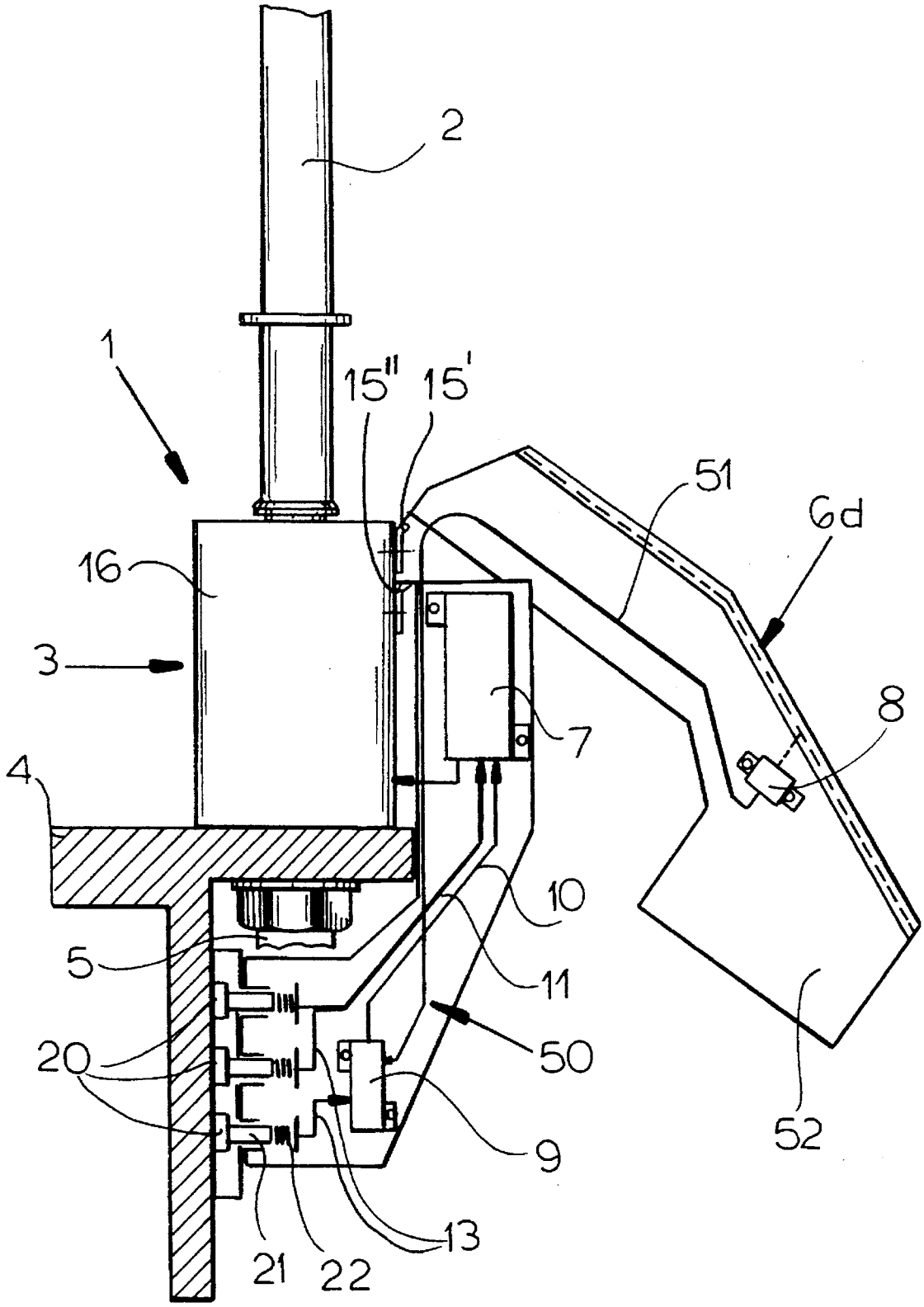
FIG. 11 is a view like FIG. 1 of a fourth embodiment of the invention in the open position.
Figure 12:
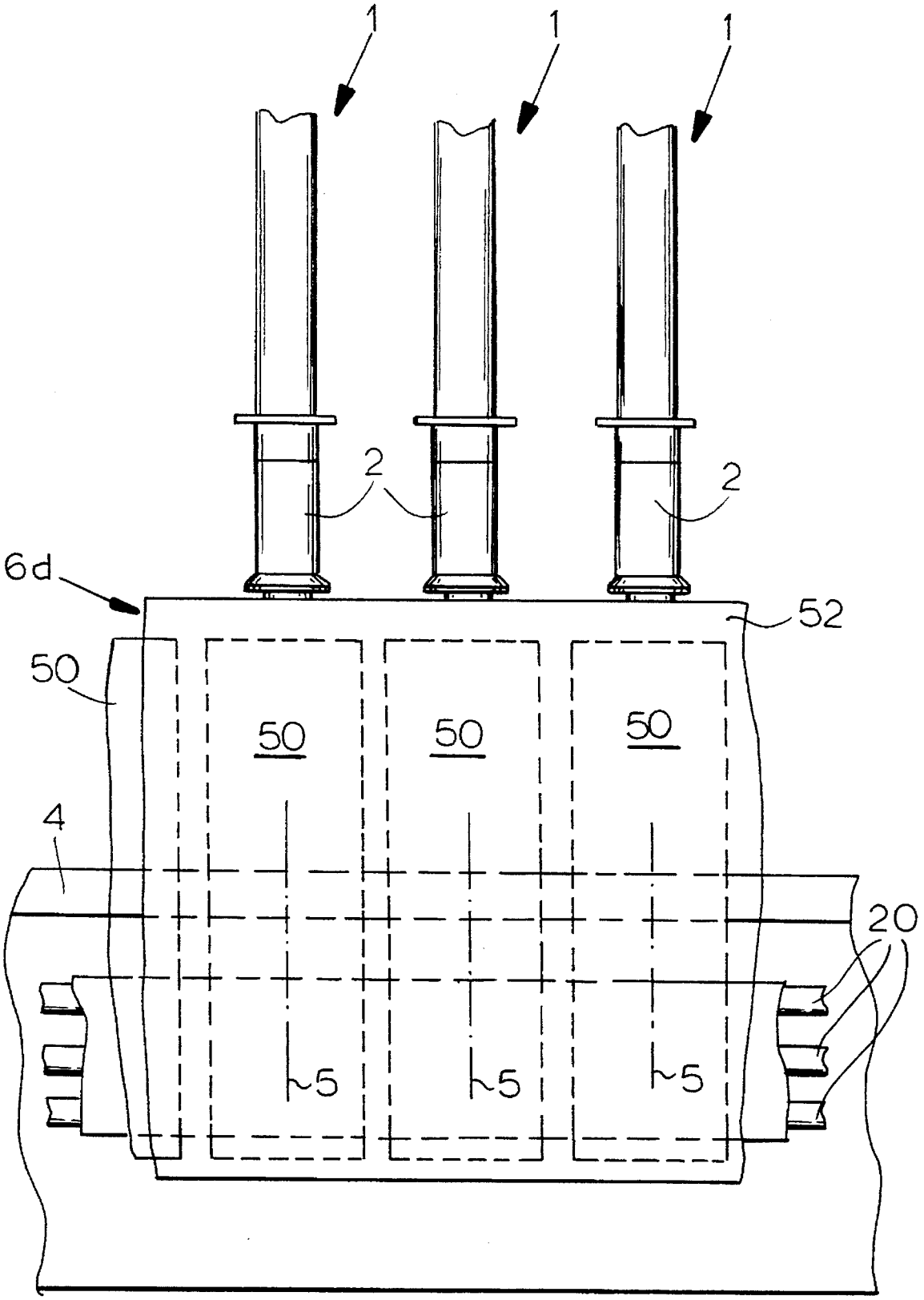
FIG. 12 is a front view of the FIG. 11 embodiment in the closed position.

FIGS. 11 and 12 show how the housing *6d* includes a housing outer part 52 carrying the cutoff switches 8 and extending over a plurality of assemblies 1 and a plurality of inner parts 50 each carrying the electrical elements 7 and 9 of a single respective assembly 1. The outer part 52 is hinged on the motor housings 16 at an upper hinge 15' and the inner parts about respective lower hinges 15". Wiring 51 extends between each cutoff switch 8 and the respective electrical elements 7 and 9.

We claim:

1. In a spinning- or twisting-machine having an elongated spindle bank;

a row of rotatable spindles supported on the bank;

respective individual drive motor on the bank for each spindle;

respective electrical control circuits connected to the respective motors and electrically energizable to power the respective motor; and a plurality of electricity-supply conductors extending along the bank past the spindles, the improvement comprising:

a respective housing support part for each spindle carrying the respective electrical control circuit and provided with electrical-input contacts; and mounting means engaged between the housing part and the spindle bank for movement of the housing part on the bank between a closed position in which the housing part surrounds and protects the respective circuit and in which the contacts conductively engage the supply conductors and an open position in which it exposes the respective circuit and disengages the contacts from the supply conductors.

2. The improvement defined in claim 1, further comprising latch means for retaining the housing support part in the closed position.

3. The improvement defined in claim 1, further comprising respective disengageable pairs of energy-output contacts between the circuits and the respective motors with each pair including one energy-output contact carried on the housing part and connected to the respective circuit and another energy-output carried on the respective motor, the energy-output contacts being engaged together in the closed position and disengaged from each other in the open position.

4. The improvement defined in claim 1, further comprising:

an outer housing shell part extending longitudinally over a plurality of housing support parts; and second mounting means separate from the first mounting means and engaged between the housing shell part and the spindle bank for movement of the housing shell part on the bank between a closed position in which the housing shell part surrounds and protects the respective circuit housing support parts and an open position in which the housing shell part exposes the respective housing support parts.

5. The improvement defined in claim 1 wherein the mounting means includes a hinge.

6. The improvement defined in claim 1 wherein the mounting means each include an upwardly open gudgeon operatively fixed on the spindle bank and a pivot pin fixed on the housing support part and pivotally engageable in the respective gudgeon.

7. The improvement defined in claim 1 wherein the spindle bank includes a respective motor housing at each spindle, the mounting means being connected between each housing support part and the respective motor housing.

8. The improvement defined in claim 1 wherein each of the contacts includes a slidable pin and a spring braced between the pin and the housing support part.

9. The improvement defined in claim 1 wherein the spindle is axially removably mounted on the spindle bank, the improvement further comprising latch means on each of the housing support parts for, in a retaining position of the latch means, retaining the respective spindles against removal from the spindle bank in the closed position of the respective housing support part.

10. The improvement defined in claim 9 wherein each housing support part includes a cutout snugly engageable in the respective closed position around the spindle and forming the latch means.

11. The improvement defined in claim 10 wherein the spindle bank includes a respective motor housing at each spindle, the latch means including guides on the motor in which the respective housing support part can slide between its open and closed positions.

12. The improvement defined in claim 9 wherein the latch means each include a respective spring braced between the respective latch means and the spindle bank and urging the latch means into the retaining position.

13. The improvement defined in claim 12 wherein the latch means includes a slide formed with a cutout engaged around the spindle and displaceable between the retaining position with the cutout engaged snugly around at least part of the spindle and a freeing position permitting the spindle to pass axially through the cutout; and means on the housing support part for urging the respective slide into the retaining position on movement of the housing support part into the closed position.

14. The improvement defined in claim 13 wherein the latch means further includes spring means braced between the respective latch means and the spindle bank and urging the latch means into the retaining position.

* * * * *